US006968642B1

(12) United States Patent
Leung

(10) Patent No.: US 6,968,642 B1
(45) Date of Patent: Nov. 29, 2005

(54) CLOSE COMBAT HANDGUARD FOR RIFLES

(75) Inventor: Fee Chan Leung, Hazlet, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/925,296

(22) Filed: Aug. 24, 2004

(51) Int. Cl.[7] ..... F41C 27/00
(52) U.S. Cl. ..... 42/86; 30/162; 30/275.4
(58) Field of Search ..... 42/86; 30/162, 30/275.4, 296.1

(56) References Cited

U.S. PATENT DOCUMENTS 35,760 A * 7/1862 Jenkinson ..... 30/162
51,690 A 12/1865 Bunsen ..... 42/61
634,466 A * 10/1899 Laird ..... 42/86
1,314,672 A 9/1919 Kozlowski ..... 42/86
1,396,969 A * 11/1921 Martino ..... 42/59

* cited by examiner

*Primary Examiner*—J. Woodrow Eldred
(74) *Attorney, Agent, or Firm*—Michael Zelenka; Roger C. Phillips

(57) ABSTRACT

A bayonet assembly, for a firearm that has a knuckleguard, includes a rail connected to the firearm where the rail comprises a first position detent and a second position detent. The bayonet assembly may also include a bayonet that, in turn, includes a blade and a slide. The slide may be dimensioned and configured to engage the rail and the slide may include a slide catch that is dimensioned and configured to be engageable with the first position detent and the second position detent. In operation, the bayonet may be slid by a hand that is located within the knuckleguard from a remote position, where the slide catch engages the first position detent, to an extended position, where the slide catch engages the second position detent.

15 Claims, 6 Drawing Sheets

CLOSE COMBAT HANDGUARD FOR RIFLES

GOVERNMENT INTEREST

The invention described herein may be manufactured, used, imported, sold, and licensed by or for the Government of the United States of America without the payment of any royalty thereon or therefor.

CROSS REFERENCE TO RELATED APPLICATION

This application is related to U.S. patent application Ser. No. 10/925,336, entitled "Close Combat Butt Stock With Blade For Assault Rifles", filed Aug. 24, 2004, which, in turn, is related to U.S. patent application Ser. No. 10/719,853, "Close Combat Butt Stock With Blade For Assault Rifles", filed Nov. 21, 2003, now U.S. Pat. No. 6,807,763.

BACKGROUND OF THE INVENTION

1. Field of the Invention

The present invention relates generally to firearms and, more particularly, to bayonets for affixing to firearms.

2. Related Art

When an army unit anticipates a close quarter combat, the command "fix bayonets" may be given. Currently, carrying out this command requires a four-step procedure including the following steps as shown in sequence in FIGS. 1A through 1D.

1. Referring first to FIG. 1A, a soldier's non-firing hand 1 may hold a firearm 2 while the other or firing hand 3 may unsheathe a bayonet 4;
2. Next, as shown in FIG. 1B, using the firing hand 3, the bayonet 4 may be aligned and mounted to a bayonet lug 5 (FIG. 1A) of the firearm 2;
3. Further, as shown in FIG. 1C, with the firing hand 3, the bayonet 4 may be locked by movement of the firing hand 3 in the direction of arrow 6 along the bayonet lug 5 of the firearm 2; and
4. Finally, referring to FIG. 1D, the firing hand 3 may be returned to a pistol grip 7 or stock 8 of the firearm 2.

It will be noted that each of these steps mandate use of a firing hand. If the enemy surprised and rushed a soldier from a short distance, the soldier may not have sufficient time to either complete all of the steps necessary to fix a bayonet or even to move the firing hand to engage a trigger of the firearm. In such a case, or where the soldier is also out of ammunition, the soldier may be forced into combat using the firearm as a club. Also, it is evident that these steps are not easily accomplished by a soldier who is running or even moving slowly.

It will also be recognized that during fighting with a bayonet, the knuckles of the non-firing hand are not protected by the current configuration of handguards on many firearms.

Previous attempts to develop firearm bayonets are noted. For example, U.S. Pat. No. 1,314,672 describes an automatic bayonet that may be released by trigger action. As illustrated in FIG. 1, a trigger controls extension of a blade via action of a helical spring. It will be noted that this bayonet assembly suffers from the drawback that the trigger may be touched by accident, e.g. during cleaning of the firearm resulting in possible non-combat injuries.

In another example, U.S. Pat. No. 51,690 describes a firearm including a bayonet that is slid between two positions. With particular reference to FIG. 8, the bayonet slides in sockets made beneath the barrel, and is secured or locked in two different positions by means of a bolt passing through the inner end of the bayonet and secured by a spring that is said to press it constantly against the barrel so as to lock the bolt in one or the other of two holes drilled in the barrel. This configuration suffers from the drawback of requiring removal of a hand from supporting the barrel of the gun in order to retract the bolt from one hole and then to push and extend the bayonet from the firearm. Also, there is no protection for the knuckles during use of the bayonet.

Accordingly, to date, no suitable bayonet assembly is available which provides for rapid extension of a bayonet blade while also allowing for adequate control over the firearm during extension of the blade. It is also found that no suitable bayonet assembly is available which provides adequate protection for the knuckles of the non-firing hand during combat with the blade.

SUMMARY OF THE INVENTION

In accordance with an embodiment of the present invention, a bayonet assembly, for a firearm that includes a knuckleguard, comprises a rail connected to the firearm where the rail comprises a first position detent and a second position detent. The bayonet assembly may also comprise a bayonet that comprises a blade and a slide. The slide may be dimensioned and configured to engage the rail and the slide may comprise a slide catch that is dimensioned and configured to be engageable with the first position detent and the second position detent. In operation, the bayonet may be slid by a hand that is located within the knuckleguard from a remote position, where the slide catch engages the first position detent, to an extended position, where the slide catch engages the second position detent.

In another aspect of the invention, a bayonet assembly for a firearm, that includes a knuckleguard, comprises means for support connected to the firearm that, in turn, comprises a first means for engaging and a second means for engaging. The bayonet assembly also includes means for sliding that may be dimensioned and configured to engage and reciprocate along the support means between the first means for engaging and the second means for engaging. The slide means may comprise a third engaging means that is dimensioned and configured to be selectively engageable with the first engaging means. The second engaging means and the slide means may comprise means for cutting extending from the slide means. In operation, the cutting means may be reciprocated from a remote position to an extended position by hand that is located within the knuckleguard.

BRIEF DESCRIPTION OF THE DRAWINGS

The following detailed description is made with reference to the accompanying drawings, in which.

DETAILED DESCRIPTION OF THE PREFERRED EMBODIMENT

One embodiment of the present invention concerns a bayonet assembly for a firearm in which a blade may be rapidly extended without loss of adequate control over the firearm while the blade is being extended. The present embodiment also provides adequate protection for the knuckles of the non-firing hand during combat with the blade.

Figure 1A:
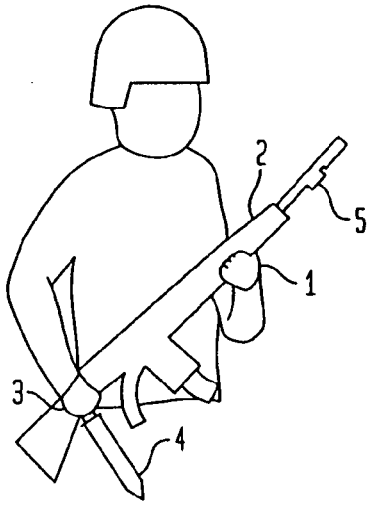
FIG. 1A (PRIOR ART)
FIGS. 1A through 1D are a sequence of views showing, a soldier holding a firearm and a bayonet and, a method of assembling the bayonet with the firearm in accordance with the prior art.
Figure 1B:
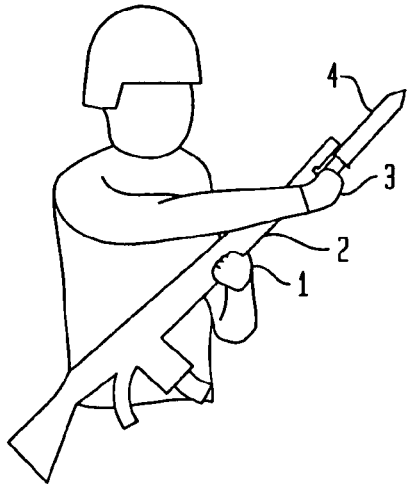
FIG. 1B (PRIOR ART)
Figure 1C:
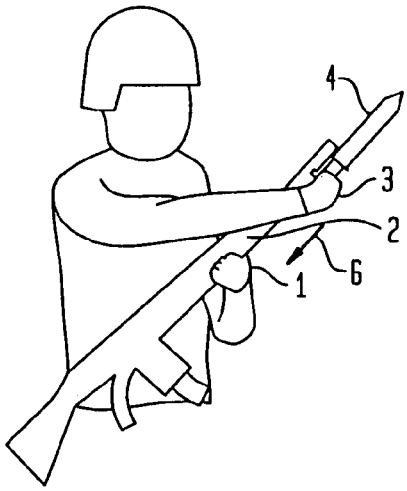
FIG. 1C (PRIOR ART)
Figure 1D:
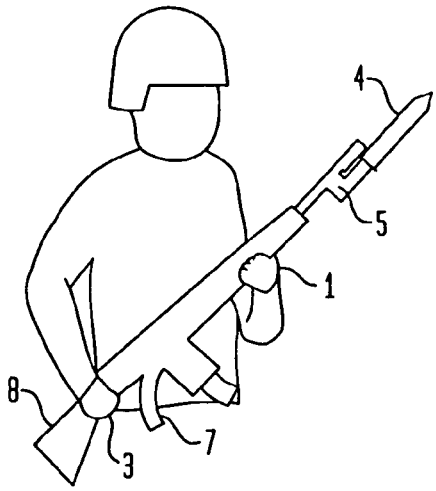
FIG. 1D (PRIOR ART)
Figure 2:
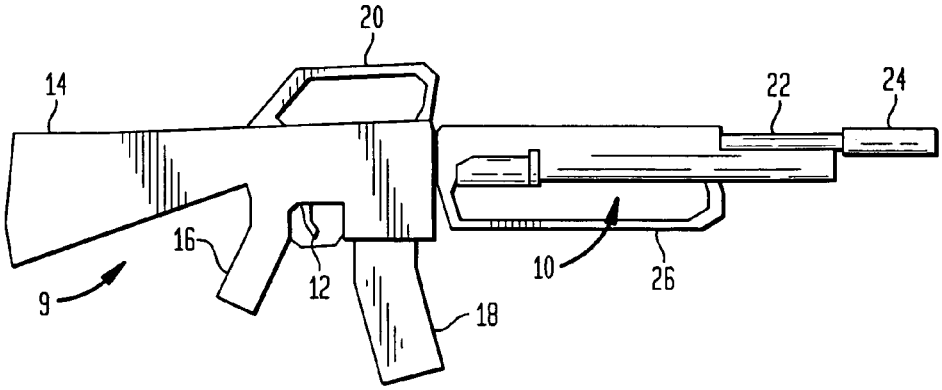
FIG. 2 is a side view showing a firearm including a bayonet assembly in accordance with one embodiment of the present invention.
Figure 5:
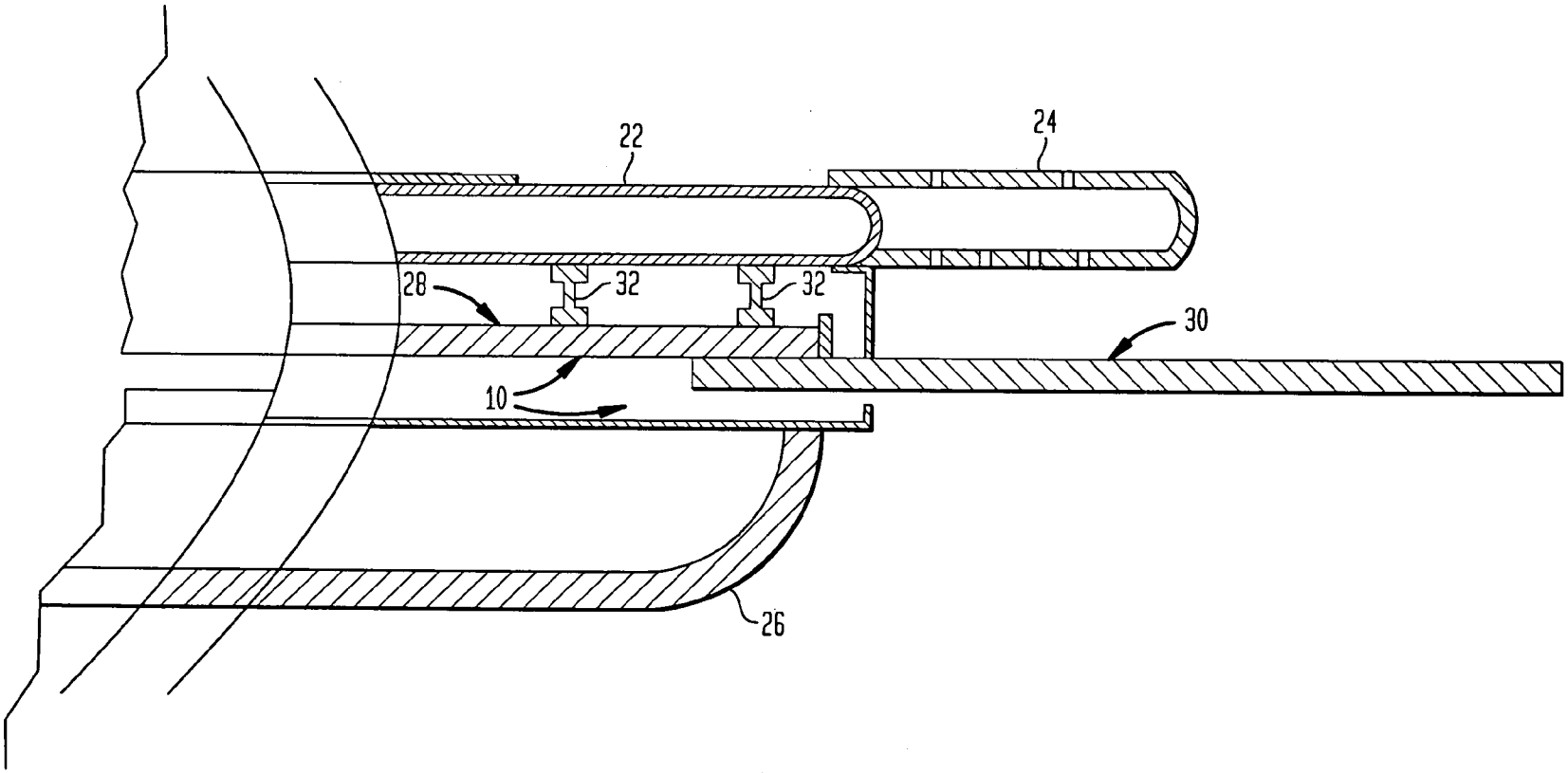
FIG. 5 is an enlarged, side view, partly in section, of a portion of the firearm and the bayonet assembly of FIG. 2.

Referring now to FIGS. 2 and 5, a firearm 9 including a bayonet assembly, in accordance with one embodiment of the present invention, is illustrated generally at 10. In this embodiment, the firearm 9 is generally illustrated as an M-16 rifle, although, it will be understood that any suitable firearm may be employed in the making and practicing of the present invention. Generally, the firearm 9 may comprise a trigger 12, a butt stock 14, a pistol grip 16 that may be gripped by a firing hand of a soldier, a magazine cartridge 18, a gun sight/handle 20, a barrel 22 and a flash suppressor 24. In addition, and in accordance with the present embodiment, the firearm is advantageously fitted with a knuckleguard 26, which will be described in more detail below and which may function to protect a non-firing hand of a soldier.

Figure 6:
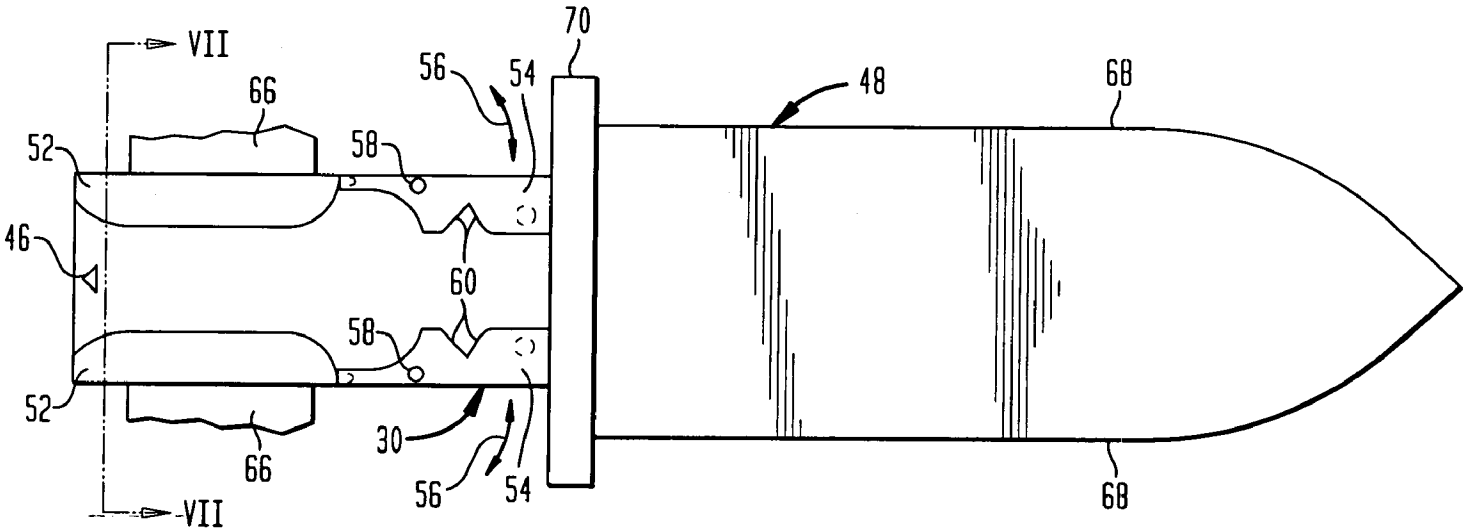
FIG. 6 is an enlarged, top view of a portion of a slide and a blade of the bayonet assembly of FIG. 2.
Figure 8:
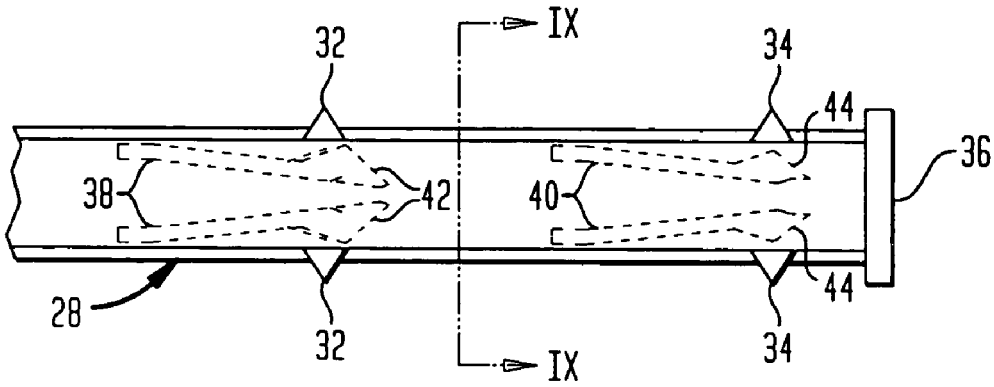
FIG. 8 is an enlarged, top view of a portion of a rail of the bayonet assembly of FIG. 2.
Figure 9:
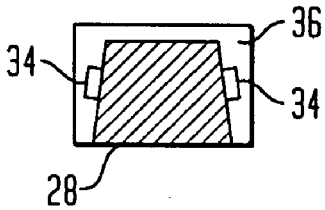
FIG. 9 is a sectional view taken along line IX of FIG. 8.

The bayonet assembly 10 is best seen in FIGS. 5 and 6 and may comprise a rail 28 and a bayonet 30. The rail 28 is supported by the firearm 9 and may be connected, as illustrated, to the barrel 22 via braces 32. Referring now also to FIGS. 8 and 9, the rail 28 may comprise a metallic substance and include a generally rectangular outer configuration and a generally trapezoidal cross-sectional shape. The rail 28 may also comprise a first position detent 32, a second position detent 34 and a stop 36. As shown in phantom, the first position detent 32 and second position detent 34 may each comprise a pair of resilient arm portions 38, 40 each of which terminate in an angled tooth 42, 44. The arm portions 38, 40 may be resiliently mounted by any suitable means such as spot welding to the rail 28 and the stop 36 may be fastened to an outer end (not numbered) of the rail 28.

Figure 3:
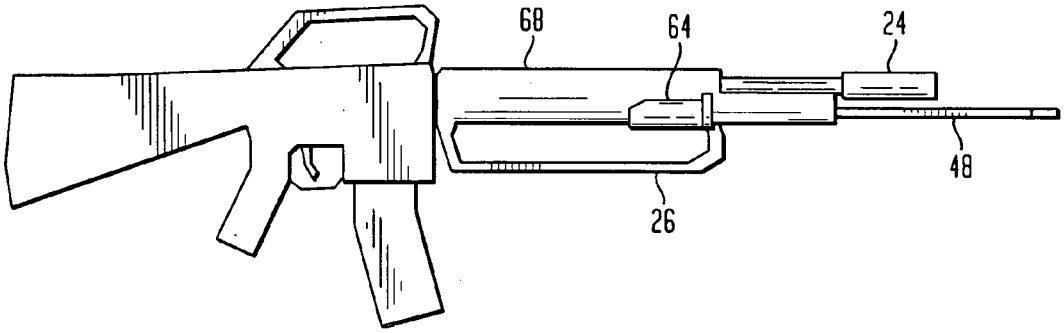
FIG. 3 is another side view of the firearm and the bayonet assembly of FIG. 2 wherein the blade of the bayonet assembly is extended.
Figure 4:
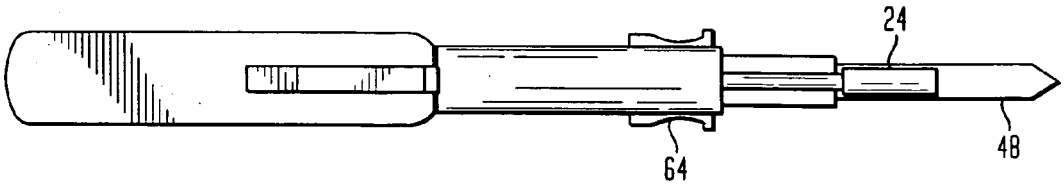
FIG. 4 is a top view of the firearm and the bayonet assembly of FIG. 2.
Figure 7:
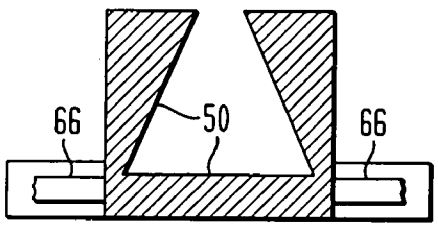
FIG. 7 is a sectional view taken along line VII of FIG. 6.

As shown in FIGS. 6 and 7, the bayonet 30 may comprise a slide 46 and a blade 48. The slide 46 may comprise a cavity 50 that is generally configured to correspond to the generally trapezoidal cross sectional shape of the rail 28 (FIG. 9) and thereby receive the rail therewithin. The slide 46 may also comprise a pair of support and alignment portions 52 for engaging the rail 28 and a pair of pivotable arms 54. Each of the pivotable arms 54 may be rotatable, in the direction of arrows 56, about a pin 58 that is connected to the slide 46. Each pivotable arm 54 may also include a triangular slot 60 for receiving an angled tooth 42, 44 of the resilient arm portions 38, 40 (FIG. 8) and a pair of bosses 62 (shown in phantom) corresponding in shape to depressions (not shown) on the slide 28 for locking the pivotable arms 54 to the slide. Referring now also to FIGS. 3 and 4, the bayonet assembly further comprises a handle 64 which may be connected to the slide 46 by neck portions 66. Advantageously, the handle 64 maybe engaged by the non-firing hand of left handed or right handed soldiers and each of the pivotable arms 54 of the slide 46 may be pressed by a thumb and a forefinger of a soldier, regardless of whether it is a right hand or a left hand, though a slot 68 in the firearm 9, in order to disengaged the slide from one or the other of the first or second position detents 32, 34 and move the bayonet 30 to an extended (FIG. 3) or unextended (FIG. 2) position.

The blade 48 may comprise any suitable metallic substance and shape for cutting and includes sharpened edge 68 and a hub portion 70.

Figure 10A:
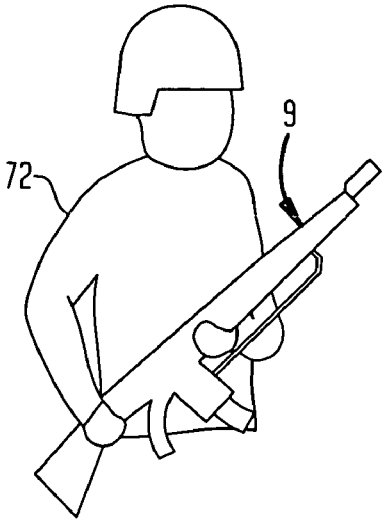
FIGS. 10A through 10C are a sequence of views showing, a soldier holding the firearm and the bayonet assembly of FIG. 2 and, a method of extending the blade of the bayonet assembly in accordance with another embodiment of the present invention.
Figure 10B:
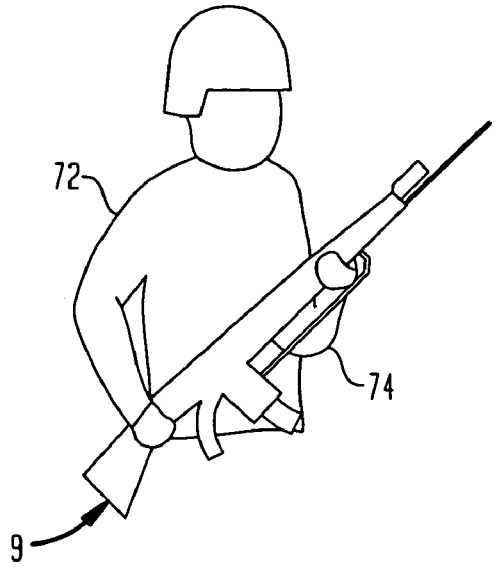
Figure 10C:
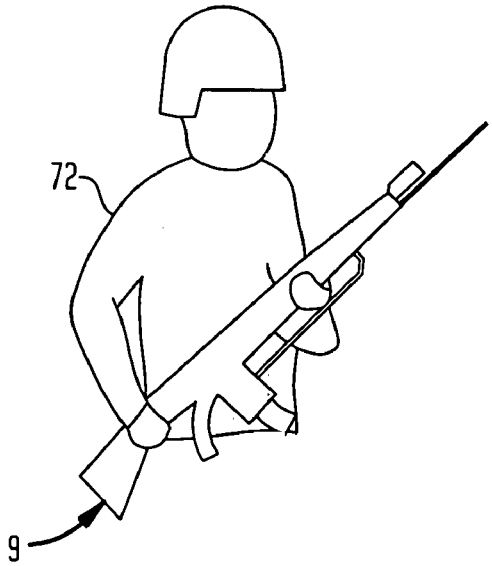

As shown in FIGS. 10A and 10B, a soldier 72 may release the bayonet 30, as described above, by disengaging the pivotable arms 54 (FIG. 6) from the first position detent 32 of the rail 28 (FIG. 8) and thereafter extending the bayonet by moving the handle 64 in the direction of arrow 74, until the pivotable arms 54 engage the second position detent 34. Referring now to FIG. 10C, the soldier 72 has now fixed the bayonet and is ready for combat.

While the present invention has been described in connection with what is presently considered to be the most practical and preferred embodiment, it is to be understood that the present invention is not limited to the herein disclosed embodiment. Rather, the present invention is intended to cover all of the various modifications and equivalent arrangements included within the spirit and scope of the appended claims.

What is claimed is:

1. A bayonet assembly for a firearm including a knuckleguard, comprising:

a rail connected to the firearm and the rail comprising a first position detent and a second position detent; and a bayonet comprising a blade and a slide, the slide being dimensioned and configured to engage the rail and the slide comprising a slide catch being dimensioned and configured to be engageable with the first position detent and the second position detent;

wherein the bayonet may be slid by a hand that is located within the knuckleguard from a remote position where the slide catch engages the first position detent to an extended position where the slide catch engages the second position detent.

2. The bayonet assembly of claim 1, further comprising a handle connected to the slide and the handle being dimensioned and configured to be gripped by either a left hand or a right hand of a soldier.

3. The bayonet assembly of claim 2, wherein:

the firearm comprises an outer cover including a slide port; and the handle comprises a neck portion that extends through the slide port and has a generally arcuate shape in cross section.

4. The bayonet assembly of claim 1, wherein:

the rail comprises a generally trapezoidal shape in cross section; and the slide comprises a central cavity being configured to correspond to the shape of the rail and for receiving the rail therein.

5. The bayonet assembly of claim 4, wherein:

the first position detent and the second position detent each comprise at least one resilient arm terminating in an angled tooth extending in a direction that is generally transverse from a longitudinal axis of the rail; and the slide catch comprises at least one pivotable arm comprising a first end having a finger push portion and a catch portion configured to correspond with the angled tooth of the at least one resilient arm.

6. The bayonet assembly of claim 5, wherein:

the first position detent and the second position detent are disposed in spaced relation along the longitudinal axis of the rail and each comprise a pair of resilient arms located on opposing sides of the rail; and the slide catch comprises a pair of pivotable arms located on opposing sides of the slide catch.

7. The bayonet assembly of claim 6, wherein each of the pivotable arms comprise at least one boss and the slide comprises at least one pair of corresponding depressions for snap locking each pivotable arm at a desired location.

8. A bayonet assembly for a firearm including a knuckleguard, comprising:

means for support connected to the firearm and comprising a first means for engaging and a second means for engaging;

means for sliding being dimensioned and configured to engage and reciprocate along the support means between the first means for engaging and the second means for engaging, the slide means comprising a third engaging means being dimensioned and configured to be selectively engageable with the first engaging means and the second engaging means and the slide means comprising means for cutting extending from the slide means;

wherein the cutting means may be reciprocated from a remote position to an extended position by hand while located within the knuckleguard.

9. The bayonet assembly of claim 8, wherein:

the support means comprises a rail and the first means for engaging comprises a first position detent and the second means for engaging comprises a second position detent; and the slide means comprises a slide, the third engaging means comprises a slide catch and the cutting means comprises a blade;

wherein the bayonet may be slid by a hand located within the knuckleguard from a remote position where the slide catch engages the first position detent to an extended position where the slide catch engages the second position detent.

10. The bayonet assembly of claim 9, wherein the bayonet assembly further comprises a handle connected to the slide and wherein the handle is configured so that it may be gripped by either a left hand or a right hand of an operator.

11. The bayonet assembly of claim 10, wherein:

the firearm comprises an outer cover including a slide port; and the handle comprises a neck portion that extends through the slide port and has a generally arcuate shape in cross section.

12. The bayonet assembly of claim 9, wherein:

the rail comprises a generally trapezoidal shape in cross section; and the slide comprises a central cavity being configured to correspond to the shape of the rail and for receiving the rail therein.

13. The bayonet assembly of claim 12, wherein:

the first position detent and the second position detent each comprise at least one movable arm terminating in an angled tooth extending in a direction that is generally transverse from a longitudinal axis of the rail; and the slide catch comprises at least one pivotable arm comprising a first end having a finger push portion and a catch portion configured to correspond with the angled tooth of the movable arm.

14. The bayonet assembly of claim 13, wherein:

the first position detent and the second position detent are spaced along the longitudinal axis of the rail and each comprise a pair of movable arms located on opposing sides of the rail; and the slide catch comprises a pair of pivotable arms located on opposing sides of the slide catch.

15. The bayonet assembly of claim 14, wherein each of the pivotable arms comprise at least one boss and the slide comprises at least one pair of corresponding depressions for snap locking each pivotable arm at a desired location.

* * * * *